US005672840A

United States Patent [19]

Sage et al.

[11] Patent Number: 5,672,840

[45] Date of Patent: Sep. 30, 1997

[54] METHOD AND APPARATUS FOR AUTOMATICALLY ORIENTING A COMPUTER DISPLAY

[75] Inventors: John Sage, Huntington Beach; Jack Ailes, Garden Grove; Mike Gonzalez, Temecula; Henry Liverpool, Jr., Rancho PV; Neil Siegel, Rancho Palos Verdes; Pirom Supapkooha, Carson, all of Calif.

[73] Assignee: TRW Inc., Redondo Beach, Calif.

[21] Appl. No.: 362,085

[22] Filed: Dec. 21, 1994

[51] Int. Cl.[6] ..... F41G 3/00; G06F 101/06

[52] U.S. Cl. ..... 89/41.01; 89/41.19; 89/41.22; 345/121; 345/133

[58] Field of Search ..... 89/41.01, 41.19, 89/41.22, 41.05, 1.11; 345/121, 133; 342/52; 395/484

[56] References Cited

U.S. PATENT DOCUMENTS

| | | | |
|---|---|---|---|
| 4,384,293 | 5/1983 | Deem et al. | 342/52 |
| 4,543,572 | 9/1985 | Tanaka et al. | 345/121 |
| 4,608,656 | 8/1986 | Tanaka et al. | 364/449 |
| 4,741,245 | 5/1988 | Malone | 89/41.19 |
| 4,949,089 | 8/1990 | Ruszkowski, Jr. | 342/52 |
| 5,297,051 | 3/1994 | Arakawa et al. | 364/449 |

*Primary Examiner*—Michael J. Carone

*Attorney, Agent, or Firm*—Robert W. Keller; G. Gregory Schivley

[57] ABSTRACT

An automatically oriented computer display for a targeting computer used in connection with a shoulder-fired missile launcher. A computer operator member of an air defense team will read a computer display from a handheld targeting computer so as to give directional and distance information of approaching aircraft. An electronic compass rigidly secured to the handheld computer continually updates the directional orientation of the computer display as the computer operator moves. Therefore, the computer operator is able to accurately give directional information to a gunner operating a shoulder-fired missile launcher such that the gunner is ready to assess the hostility of the approaching aircraft as they become visible. An embedded computer is provided to decipher the compass signals so they are readable by the handheld computer. Additionally, a global positioning system receiver is provided to give positional information of the gunner and the computer operator.

13 Claims, 2 Drawing Sheets

METHOD AND APPARATUS FOR AUTOMATICALLY ORIENTING A COMPUTER DISPLAY

BACKGROUND OF THE INVENTION

1. Field Of The Invention

This invention relates generally to a system for automatically orienting a computer display with respect to a particular direction and, more particularly, to a system that includes an electronic compass that automatically orients a computer display associated with a handheld targeting computer in order to direct a shoulder-fired missile.

2. Discussion Of The Related Art

Part of the U.S. Army combat strategy involves providing two-man teams of soldiers with a handheld targeting computer and a shoulder-fired missile launcher for the purpose of providing divisional air defense. FIG. 1 provides a depiction of this strategy where a team of two soldiers is represented generally at 10. A first member of the team 10 is a computer operator 12 who wears a handheld targeting computer 14 secured by a harness 16 around his neck. The handheld computer 14 is a known MS-DOS computer developed by the military specifically for the purpose described herein. The harness 16 will position the computer 14 in such a manner that the computer 14 sits horizontally in front of the chest of the computer operator 12 so that a computer screen 18 associated with the computer 14 faces upwards and is visible to the computer operator 12. A military radio (not shown in FIG. 1) secured within a backpack 20 supported on the back and shoulders of the computer operator 12 receives appropriate radar signals from a remote transmitter (not shown) by an antenna 22. The radio is a standard army inventory backpack radio such as a single channel ground to air radio system (SINCGARS) or an enhanced position location radio system (EPLRS). The radio transmits the radar signals to the computer 14 by a cable 24.

The computer 14 generates a map display including stylized map overlays on the screen 18 to be read by the computer operator 12. Objects, such as aircraft, that are detected by the radar system and transmitted to the radio will be sent to the computer 14 and will occur as symbols on the screen 18. The map display on the screen 18 will include a set of concentric rings around the representation of the position of the team 10 in which the rings represent distances from the team 10 as with a traditional radar screen. The display will also provide other information such as speed, altitude and direction of the aircraft on the screen 18.

A second member of the team 10 is a gunner 26 who carries a shoulder-fired, anti-aircraft missile launcher 28 that fires an appropriate missile (not shown), such as a STINGER missile, at a desirable air-borne target at the appropriate time. In order to find such desirable targets, the computer operator 12 reads the screen 18 and verbally indicates to the gunner 26 directional, altitude, speed and distance information of approaching hostile aircraft. Therefore, when the hostile aircraft becomes visible to the gunner 26 through a telescopic sight associated with the missile launcher 28, the gunner 26 is prepared to identify the aircraft as hostile, and then to fire the missile if appropriate.

In the prior art approach, the computer 14 generates the computer image on the screen 18 such that the directional representation of a particular compass direction, such as North, is at the top of the computer screen 18 facing away from the computer operator 12 regardless of which direction the computer operator 12 is actually facing. The operator 12 may change the orientation of the display such that South, East, West or the bearing of a primary target line is at the top of the computer screen 18. In order for the computer operator 12 to give the gunner 26 accurate directional information of approaching aircraft prior to the aircraft being visible to the gunner 26 so as to enable the gunner 26 to be ready when the aircraft does become visible, the computer operator 12 will generally physically orient the computer screen 18 such that the top of the screen 18 is actually pointing in the direction as represented on the screen 18. In order for the computer operator 12 to know the compass directions relative to the position of the team 10, the computer operator 12 carries a handheld compass (not shown). Once the computer operator 12 is facing a known direction relative to the map display on the screen 18, the computer operator 12 will then determine a number of points from which directional information can be given to the gunner 26. For example, the computer operator 12 may first determine the direction of due north, then determine a landmark to be a direction relative to due north. The gunner 26 will determine the direction of approaching aircraft from this reference point as called out by the computer operator 12.

A problem may arise in the above-described situation that will prevent the gunner 26 from receiving accurate directional information of approaching aircraft from the computer operator 12. Particularly, if the computer operator 12 is not oriented correctly with respect to the direction represented on the screen 18, he may give incorrect verbal azimuth readings to the gunner 26. Consequently, the gunner 26 will not be facing the correct direction when the aircraft becomes visible. Because the telescopic sight associated with the missile launcher 28 has a very narrow field of view, if the gunner 26 is not properly oriented with respect to approaching aircraft, the gunner 26 may not be able to recover fast enough to the correct orientation that will enable him to first assess the hostility of the aircraft and then fire upon the aircraft if appropriate, thus causing a loss of shot opportunity. Problems with the computer operator 12 becoming disoriented with respect to the known direction is even further increased in the high-stress, low visibility, quick-response environment of a modern battlefield.

What is needed is a system that causes the computer display to be automatically oriented to a particular direction as the computer operator moves and turns about his position. It is therefore an object of the present invention to provide such a system.

SUMMARY OF THE INVENTION

In accordance with the teaching of the present invention, a system for automatically orienting a computer display with respect to a known direction is disclosed that is applicable to be used in an air defense strategy system incorporating a handheld targeting computer and a shoulder-fired missile. A computer operator member of an air defense team carries a handheld targeting computer such that a computer display associated with the handheld computer faces vertical to be read by the computer operator. The computer operator also carries a radio that receives radar signals of airborne targets from a remote transmitter associated with a radar system. The radar signals received by the radio are transmitted to the targeting computer which then generates radar images on the computer display in connection with appropriate map display software associated with the targeting computer.

An electronic compass is rigidly attached to the handheld computer at an appropriate location. The electronic compass provides output compass signals indicative of the orientation of the handheld computer with respect to compass directions. A control computer receives the compass signals and converts the compass signals to computer signals readable by the handheld computer. Therefore, as the computer operator turns about his position, the electronic compass provides directional signals of this movement such that the targeting computer can redraw the map display so that the radar images on the display are accurately represented with respect to the computer operator's orientation. Consequently, the computer operator will give accurate directional information to a gunner member of approaching aircraft so the gunner can be ready to assess the hostility of the approaching aircraft and fire the missile if appropriate.

A global positioning system receiver can also be included to provide positioning signals to the control computer so as to establish a precise position of the team. Further, a personal computer can be connected to the control computer to provide recording and debugging operations.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments concerning automatically orienting a computer display associated with a handheld computer that displays a radar map in order to direct a shoulder-fired missile launcher is merely exemplary in nature and is in no way intended to limit the invention or its applications or uses. Particularly, the preferred embodiments directed to automatically orienting a computer display has application in many other types of computer displays including, but not limited to, map displays for surveying, navigating, etc.

Figure 1:
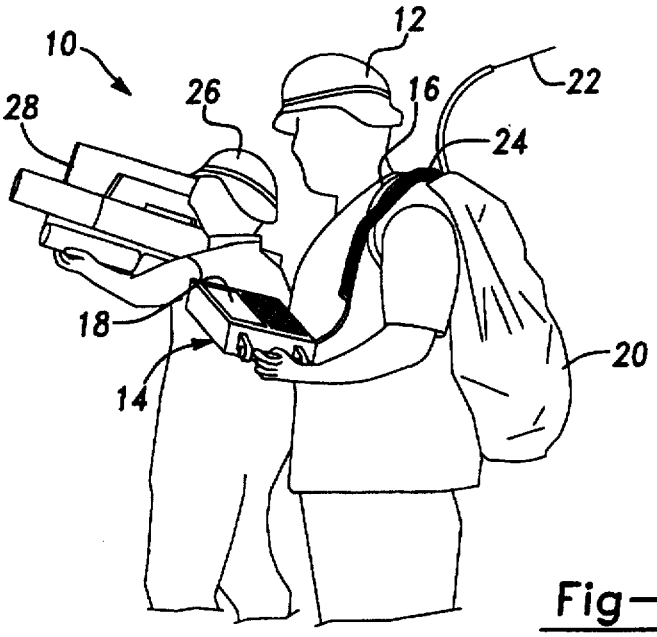
FIG. 1 is a perspective view of a two-man team of soldiers using an automatically oriented computer display according to a preferred embodiment of the present invention.
Figure 2:
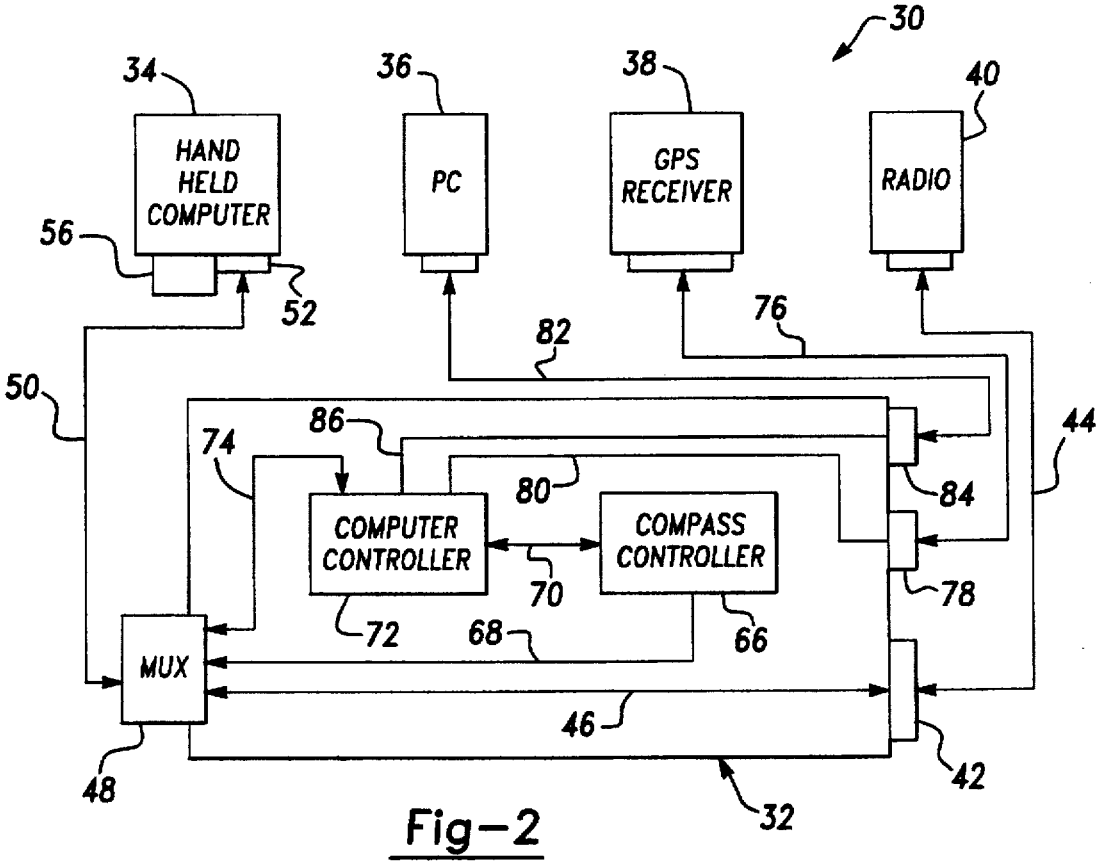
FIG. 2 is a first functional block diagram of a system for automatically orienting a computer display according to a preferred embodiment of the present invention.

With the above caveat in mind, turn to FIG. 2 in which a functional block diagram of a system 30 that is capable of automatically orienting a computer display to a known direction is shown. The system 30 includes an embedded computer 32 electrically connected to each of a handheld targeting computer 34, a personal computer (PC) 36, a global positioning system (GPS) receiver 38, and a radio 40. Each component of the system 30 just mentioned will be discussed in detail below as being part of a divisional air defense strategy incorporating a shoulder fired missile as discussed above with reference to FIG. 1.

The handheld targeting computer 34 is the same type as the handheld computer 14 discussed above. The radio 40 can be a standard army inventory backpack radio such as SINCGARS or EPLRS discussed above within the backpack 20 that receives radar signals. The radio 40 receives radar signals by an antenna, such as the antenna 22 of FIG. 1, and transfers these radio signals through the embedded computer 32, in a manner that will be discussed below, to the handheld computer 34 such that the handheld computer 34 can display a radar map of a scene. The handheld computer 34 is used in connection with map-control software known in the art. The map-control software associated with the computer 34 uses the information received by the radio 40, and integrates the information onto a display (not shown in FIG. 2) along with stylized map overlays. The map-control software is a well known part of the defense scheme discussed above with reference to FIG. 1.

In the embodiment of the present invention, the radar signals received by the radio 40 are transmitted to the handheld computer 34 through the embedded computer 32. Particularly, the signals from the radio 40 are applied to an electrical port 42 associated with the embedded computer 32 on a line 44. The radar signals are then transferred via a bus 46 within the computer 32 to a multiplexing port 48 of the embedded computer 32. A line 50 is connected to the port 48 and to a serial communications port 52 associated with the computer 34 such that electrical signals can be transmitted back and forth between the radio 40 and the handheld computer 32. The multiplexing port 48 also multiplexes other computer signals onto the line 50 to be received by the computer 32 as will be discussed below.

An electronic compass 56 is attached to the handheld computer 34 in order to provide automatic orientation of the computer display associated with the computer 34. The electronic compass 56 is an electronic device that senses the magnetic north direction and provides an electrical output signal indicative of the direction of the compass relative to magnetic north. In a preferred embodiment, the electronic compass 56 is based on flux-gate technology, and as such can be a C100 Compass Engine commercially available from KVH Industries, 110 Enterprise Center, Middletown, R.I. 02940. The electronic compass 56 is rigidly secured to the handheld computer 34 by a securing device 58 so that it will follow the motion of the handheld computer 34 as the computer operator 12 moves. The device 58 can be any appropriate mechanism that will rigidly secure the compass 56 to the computer 34. Applicable devices include, but are not limited to, bolts, adhesives, welds, etc. The electronic compass can be secured to the handheld computer 34 at any convenient location such that it does not interfere with the computer operator 12. In one embodiment, the compass 56 is secured to the computer 34 by a bracket and bolt configuration in close proximity to the port 52.

The output signals of the compass 56 are applied to the line 50 through the port 52. As the computer 34 moves and rotates with the movement of the operator 12, signals from the electronic compass 56 are transmitted along the line 50 to the embedded computer 32 at the port 48. The multiplexing port 48 sends the raw compass signals to a compass controller 66 within the embedded computer 32 on a line 68. The compass controller 66 converts the raw compass signals to industry standard computer signals, such as IEEE RS-232 signals readable by the computer 34. These signals are then transmitted on a line 70 to a computer controller 72. The signals are processed by the controller 72 until they are outputted from the controller 72 on a line 74 to the port 48 and then to the computer 34 on the line 50. Therefore, as the computer operator 12 moves, the electronic compass 56 continually sends orientation signals, for example, now pointing 59° east of due north magnetic, to the embedded computer 32 where they are converted to signals that can be used by the handheld computer 34. It is noted that in a separate embodiment, the handheld computer 34 could include a compass controller such that the output compass signals from the electronic compass 56 would be applied directly to the computer 34 without having to be sent to the embedded computer 32 without departing from the spirit and scope of the invention.

The electronic compass 56 is continually sending the electronic compass signals to the embedded computer 32. These compass signals are converted to the computer signals by the compass controller 66 as they are received by the compass controller 66. The computer controller 72 sends the converted computer signals from the compass controller 66 to the port 48 along with other computer signals controlled by the controller 72 in an event driven manner that will be discussed below. However, the handheld computer 34 does not act on the computer signals that are converted from the compass signals until the compass 56 has indicated that the handheld computer 34 has rotated a threshold amount. This threshold amount is part of the map-control algorithm software that provides the computer display. In one embodiment, this threshold amount is 27½° as based on a change from one cardinal compass direction to another cardinal compass direction. In other words, the orientation of the computer 34 must at least change from one of the eight cardinal compass directions North, Northeast, East, Southeast, South, Southwest, West, or Northwest to a next cardinal compass direction in order for the computer 34 to act on the directional information. Once the computer 34 has moved this threshold amount, the map display software causes the map display to be quickly and automatically redrawn in a new orientation where one of the compass cardinal points will be at the top of the computer screen.

The GPS receiver 38 receives global positioning signals from a remote transmitter associated with a satellite positioning network which gives accurate positional information of the position of the team 10. The global positioning system is a well known system that uses satellite triangulation signals from satellites orbiting the Earth that are synchronized on a time basis to give positional information to a series of receivers. As such, the GPS receiver 38 is a commercially available device such as a GPS NAV 1000M™ available from Magellan Systems Corporation, 260 E. Huntington Drive, Monrovia, Calif. 91016. Further, the GPS receiver can be a U.S. Army standard GPS receiver.

The global positioning signals received by the receiver 38 are sent from the receiver 38 on a line 76 to a port 78 associated with the embedded computer 32. The positional information is then applied to the controller 72 on a line 80 within the embedded computer 32. The positional information from the GPS receiver 38 is cued for transmission by the controller 72 to be sent to the handheld computer 34 on the line 74 through the port 48. Therefore, like the signals on the line 70 from the compass controller 66, the signals on the line 80 are processed by the controller 72 and then applied to the line 74. The GPS receiver 38 can be positioned within the backpack 20, secured to the belt of the computer operator 12, or be secured to the person of the computer operator 12 in some appropriate fashion.

The personal computer 36 allows data recording and debugging signals to be applied to and received from the controller 72. Particularly, the personal computer 36 is connected by a line 82 to a port 84 associated with the embedded computer 32. Signals received at the port 84 from the personal computer 36 are transmitted on a line 86 to the controller 72. The personal computer 36 can be any computing device that has the ability to record asynchronous IEEE RS-232 ASCII data for information interchange. The personal computer 36 will generally not be connected to the embedded computer 32 during normal operation, such as in a combat situation. The personal computer 36 generally will be connected to the embedded computer 32 under laboratory conditions for providing such functions as mission analysis, archiving, testing and verification.

The handheld computer 34 is an MS-DOS computer developed by the military with one serial and one combat communications port. The port 52 represents the single connector accessing the serial and the combat communications port. The serial port receives information of three functions as described in the above embodiment. These three functions include data recording by the personal computer 36, unit positioning by the GPS receiver 38, and unit heading from the electronic compass 56. Because there is only one port, only one of these functions can be accomplished at any time. The controller 72 allows all three functions to be accomplished at the same time by interleaving the signals onto the port 48 on an event driven basis to be received by the port 52. Therefore, the embedded computer 32 is responsible for processing signals received from the radio 40, and for multiplexing these signals to the line 50 connected to the computer 34. In the current implementation, the radio signals are passed directly via wires to the multiplexing port 48. This implementation cuts down the tangle of wires by one (the one from port 52 to radio 40). Additionally, the embedded computer 36 is responsible for receiving position and time signals from the GPS receiver port 78, and for multiplexing the signals to the line 50 connected to the handheld computer 34.

Figure 3:
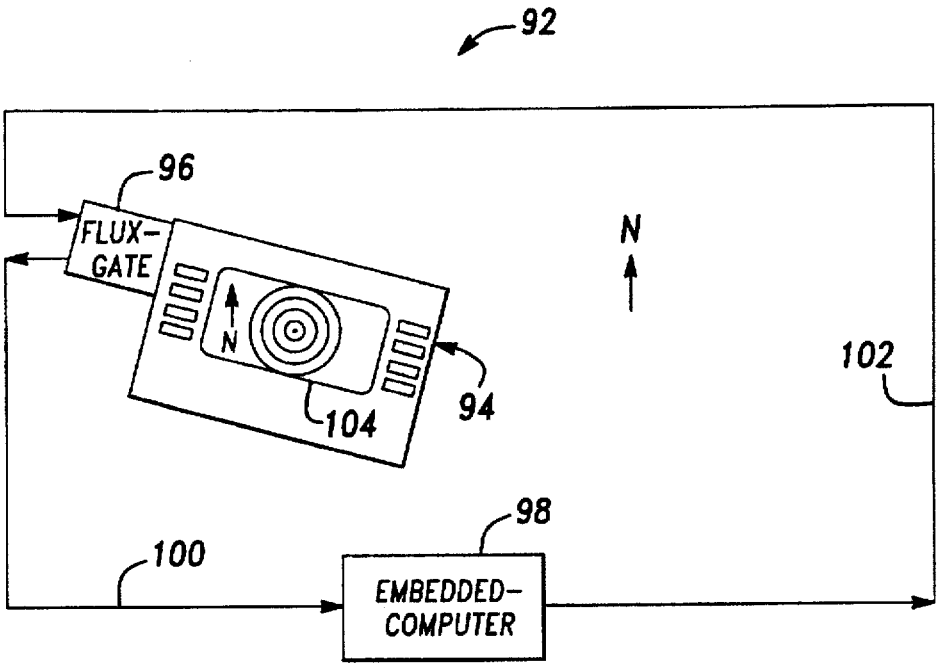
FIG. 3 is a second functional block diagram of a system for automatically orienting a computer display according to a preferred embodiment of the present invention.

FIG. 3 shows a block diagram representation of a system 92 depicting only the process of automatically orienting a computer display as discussed above. The system 92 includes a handheld computer terminal 94, an electronic flux gate compass 96 attached to the computer terminal 94, and an embedded computer 98 all being the same as the computer 32, the electronic compass 56 and the embedded computer 36, respectively, of FIG. 2 above. FIG. 3 shows the handheld computer terminal 94 being rotated 30° towards the east from due north. When the computer terminal 94 is first oriented in this manner, the electronic compass 96 will send a signal on a line 100 to the embedded computer 98 indicative of this position relative to due north. The embedded computer 98 converts these raw compass heading signals to signals the handheld computer terminal 94 can decipher, and then sends the converted signals on a line 102 to the terminal 94. The handheld computer terminal 94 receives the signals on the line 102 and updates a display 104 associated with the computer terminal 94 being read by the computer operator 12. The display 104 shows a normalized vector representing due north that has been updated from the original due north direction relative to the terminal 94. The display 104 is being continually updated in this fashion as the handheld computer terminal 94 is moved in accordance with the operation of the controller 72 that sends information to and from the embedded computer 98. Of course, the rate at which the display is updated is dependent on the other functions as discussed above. However, all of the functions are performed very quickly such that it appears that changes in orientation on the display 104 occur as fast as the terminal 94 is moved. Also, the computer terminal 94 must rotate the threshold amount before the computer terminal 94 will act on the directional signal from the embedded computer 98.

The embedded computer 32 is a relatively small computer that can be secured to the belt of the computer operator 12 or that can be carried in or attached to the backpack 20 by some appropriate mechanism. The embedded computer 36 is a commercially available device such as the CPU-186 single-board computer available from Computer Dynamics, 105 South Main Street, Greer, S.C. 29650. Consequently, the specific operation of the compass controller 66 and the computer controller 72 are well known.

Figure 4A:
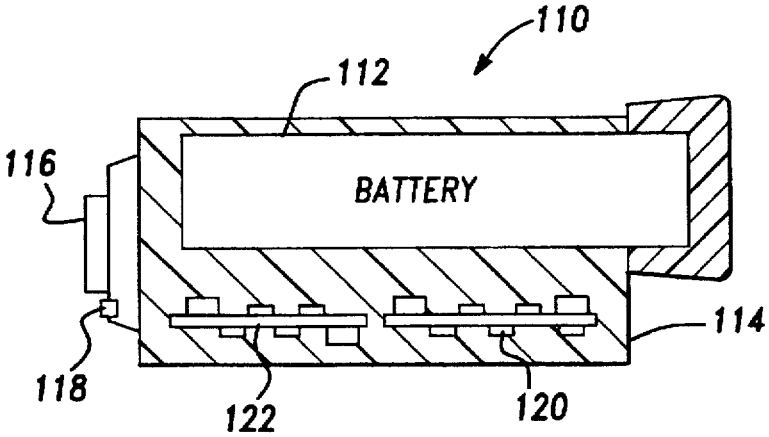
FIGS. 4(*a*) and 4(*b*) are a diagrammatic side view and an end view, respectively, of a computer included as part of the system for automatically orienting a computer display according to a preferred embodiment of the present invention.
Figure 4B:
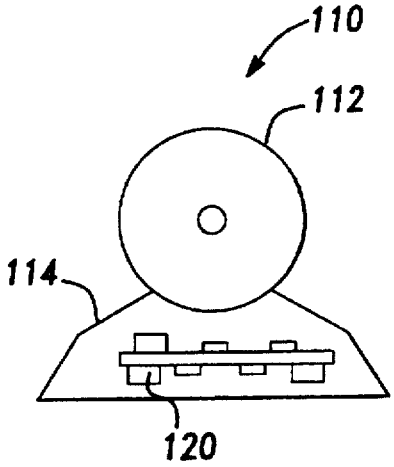

FIGS. 4(*a*) and 4(*b*) show a side view and an end view, respectively, of an embedded computer 110 of the type that could be used as the embedded computer 36, discussed above. As is apparent, the embedded computer 110 includes a battery 112, such as a rechargeable nickel cadmium battery, and a base portion 114. A radio connector port 116 is attached at one end of the embedded computer 110 and is the same as the port 42 discussed above. Additionally, a port 118 is shown and is similar to the port 84 discussed above used to connect to the personal computer 80. The base portion 114 includes a multiplexer controller board 120 of the type of the controller 72 above including various computer chips as shown. Additionally, the base portion 120 includes a compass controller 122 including various computer chips and is the same type as the compass controller 66 discussed above. In a preferred embodiment, the embedded computer 98 is approximately 4.5 inches long and approximately 2.5 inches wide.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A system for automatically orienting a computer display, said system comprising:

a first computer that is portable and includes the computer display that is oriented in an initial direction, said first computer being operative to reorient the direction of the display in response to computer signals;

an electronic compass secured to the first computer, and being operative to generate compass signals with reference to a particular compass direction in response to movement of the first computer; and a second computer, said second computer including a compass controller and a computer controller, said compass controller being responsive to the compass signal from the electronic compass and being operative to generate computer signals indicative of the compass signals, said first computer being responsive to the computer signals from the computer controller so as to reorient the positional direction of the display so it is aligned in accordance with a particular direction with the movement of the first computer, said computer controller being responsive to computer signals, and processing the computer signals to be sent to the first computer on a single line in accordance with an interleaving scheme.

2. The system according to claim 1 further comprising a radio, said radio being responsive to positional information of objects and transmitting positional signals of the objects to the first computer, said first computer displaying signals representative of the position of the objects on the computer display.

3. The system according to claim 1 further comprising a global positioning system receiver, said global positioning system receiver sending position signals to the first computer, wherein the position signals are indicative of the position of the system.

4. The system according to claim 1 further comprising a third computer, said third computer providing recording and debugging signals to the second computer.

5. The system according to claim 1 wherein the first computer is a targeting computer used in association with a shoulder-fired missile launcher.

6. The system according to claim 2 wherein the radio is selected from the group consisting of a single channel ground to air radio system and an enhanced position location radio system.

7. The system according to claim 1 wherein the electronic compass is a flux-gate electronic compass.

8. A system for automatically orienting directional information being displayed on a computer display being viewed by a computer operator so as to enable the computer operator to give accurate directional information of computer display signals of aircraft being shown on the display to a gunner operating a shoulder-fired missile launcher, said system comprising:

a hand-held targeting computer capable of being held by the computer operator, said hand-held computer including the computer display;

a radio receiving positional information of the aircraft and transmitting positional signals of the aircraft to the hand-held computer, said hand-held computer displaying signals indicative of the aircraft position on the computer display;

an electronic compass secured to the hand-held computer, said electronic compass generating compass signals with reference to a particular compass direction in response to the movement of the hand-held computer; and an embedded computer responsive to the compass signals from the electronic compass, said embedded computer including a compass controller that is responsive to the compass signals and generates computer signals indicative of the compass signals, said embedded computer further including a computer controller responsive to the computer signals from the compass controller, wherein the hand-held computer is responsive to the computer signals from the embedded computer so as to adjust the directional information on the display in accordance with the movement of the computer operator; and a global positioning system reciever, said global positioning system receiver sending position signals to the embedded computer, said computer controller within the embedded computer being responsive to the position signals from the global positioning system receiver, said computer controller sending the computer signals from the compass controller and the position signals from the global positioning system receiver to the hand-held computer along a single line in accordance with an interleaving scheme.

9. The system according to claim 8 further comprising a personal computer, said personal computer providing recording and debugging signals to and from the embedded computer.

10. The system according to claim 8 wherein the radio is selected from the group consisting of a single channel ground to air radio system and an enhanced position location radio system.

11. A method for automatically orienting a computer display, said method comprising the steps of:

providing a first computer including the computer display, said first computer being a portable computer;

providing an electronic compass structurally connected to the first computer to cause the electronic compass to move with the movement of the first computer, wherein the electronic compass generates compass signals with reference to a particular compass direction in response to the movement of the first computer such that the display is updated and reoriented in accordance with the movement of the first computer;

providing a second computer including a compass controller and a computer controller;

sending compass signals from the electronic compass to the compass controller within the second computer said compass controller converting the compass signals to computer signals;

sending the computer signals from the compass controller to the computer controller;

sending the computer signals from the computer controller to the first computer to reorient the computer display; and providing a global positioning system receiver that sends position signals to the computer controller within the second computer of the position of the system receiver, said computer controller using an interleaving scheme to send computer signals from the global positioning system receiver and the computer signals from the compass controller to the first computer along a single line.

12. The method according to claim 11 further comprising the step of providing radio positional signals of objects to the first computer, wherein the step of providing a first computer includes providing a first computer that displays signals representative of the position of the objects on the computer display.

13. The method according to claim 11 wherein the step of providing a first computer includes providing a targeting computer used in association with a shoulder-fired missile launcher.

* * * * *